United States Patent [19]

Gonzalez

[11] Patent Number: 4,669,135

[45] Date of Patent: Jun. 2, 1987

[54] SOFA BED WITH FRONT EXTENSION

[75] Inventor: Jose M. Gonzalez, South Gate, Calif.

[73] Assignee: Kustom Fit Manufacturing Co., Ltd., South Gate, Calif.

[21] Appl. No.: 906,845

[22] Filed: Sep. 15, 1986

[51] Int. Cl.[4] ..... A47C 17/04; A47C 1/02

[52] U.S. Cl. ..... 5/37 R; 5/13; 5/16; 5/37 B; 5/53 C; 5/57 R; 5/57 B; 5/57 E; 297/85; 297/89

[58] Field of Search ..... 5/13, 16, 37 R, 37 B, 5/51 G, 53 C, 47, 51 M, 55 B, 57 R, 57 B, 57 E, 57 C; 297/83, 84, 85, 88, 89

[56] References Cited

U.S. PATENT DOCUMENTS

| | | | |
|---|---|---|---|
| 3,302,969 | 2/1967 | Mizelle et al. | 297/85 |
| 3,850,475 | 11/1974 | Katz et al. | 297/85 |
| 4,000,529 | 1/1977 | De Maria | 5/13 X |
| 4,131,960 | 1/1979 | Quackenbush | 5/37 R |
| 4,200,941 | 5/1980 | Gill et al. | 5/13 |
| 4,307,912 | 12/1981 | Watt et al. | 297/85 |
| 4,543,675 | 10/1985 | Shrock | 5/18 R X |
| 4,563,784 | 1/1986 | Shrock et al. | 5/47 X |
| 4,569,093 | 2/1986 | Hermann | 5/47 |
| 4,601,074 | 7/1986 | Welsch et al. | 5/47 |

FOREIGN PATENT DOCUMENTS

| | | | |
|---|---|---|---|
| 503576 | 9/1952 | Belgium | 5/57 R |
| 674115 | 11/1963 | Canada | 297/89 |
| 68785 | 6/1958 | France | 5/57 R |
| 80211 | 2/1963 | France | 5/37 R |
| 195595 | 2/1958 | German Democratic Rep. | 5/47 |
| 954161 | 4/1964 | United Kingdom | 5/57 R |

*Primary Examiner*—Thomas J. Holko
*Assistant Examiner*—Carl M. DeFranco, Jr.
*Attorney, Agent, or Firm*—Francis X. LoJacono

[57] ABSTRACT

A sofa bed includes a plurality of individual cushions supported by a rigid metal frame. The frame includes a plurality of multiply articulated frame members which cooperate to configure the cushions in either of two selected positions. The first defines a sofa configuration and the second defines a bed configuration in which the cushions are coplanar arranged in a horizontal plane. A latching mechanism is provided which produces a positive locking of support position in either of two configuration without the use of retaining springs or overcenter articulated arm combinations.

6 Claims, 9 Drawing Figures

SOFA BED WITH FRONT EXTENSION

FIELD OF THE INVENTION

This invention relates generally to foldable sofa beds and particularly to sofa beds in which an articulated frame supports a plurality of cushions such that the cushions are alternatively moveable between positions corresponding to a bed or sofa and in which means for latching the articulated frame are provided.

BACKGROUND OF THE INVENTION

The need to make best use of limited interior space in bedrooms or to provide additional sleeping facilities in rooms not normally utilized completely as bedrooms, has prompted furniture fabricators to create a number of products which are capable of functioning as sofas or beds. Generally, such products are known as "sofa beds" and comprise multiple cushions and frame arrangements supporting the cushions by which the cushions may be configured in a position corresponding to a sofa or couch or an alternative position corresponding to a bed. A number of such products have been created through the years and have taken a wide variety of configurations and structures. However, the most common types presently employed provide a rigid frame, usually of steel members, arranged with articulated linkage configuration whereby the cushion supports, and thereby the cushions, may be arranged in alternative configurations.

By way of example, U.S. Pat. No. 4,512,048 sets forth a sofa bed which is adapted to be mounted within the interior of a automotive van. The sofa bed includes a front cushion, a rear cushion and an intermediate cushion therebetween. The cushions are pivotally mounted on a rigid steel frame which in turn is secured to the interior surfaces of the van. In the portion of the U.S. Pat. No. 4,512,048 pertinent to the present invention, the linkage is configured to allow the intermediate cushion to be pivoted between a first upright position in which it forms the seat back of a sofa and in combination with the horizontally positioned front cushion forms a bench seat and a second folded down position in which the front and intermediate cushions are aligned and horizontally positioned to form a sleeping surface in the bed configuration.

U.S. Pat. No. 4,480,344 sets fortth a divan-bed in which a frame includes a plurality of articulated leaves, each of which are covered by a continuous one-piece mattress. The end leaves on each opposite end are positioned together at an approximate right angle to form the seat and seat back of a sofa when the divan is configured in the sofa arrangement. In the sofa position, the intermediate leaves are folded into and store within the base of the divan deneath the divan seat. The structure may be reconfigured into a bed by drawing the end leaf serving as a seat portion forward. The linkage arrangement in the support structure moves the remaining segments of the support into a straight line horizontal configuration in response to the drawing force.

U.S. Pat. No. 2,721,337 sets forth a bed-davenport having essentially three cushion elements. In the sofa or davenport position, the first corresponds to the upright back portion of the sofa and the intermediate cushion drops into and is stored within the support structure. The front portion pivots so as to overlie the intermediate portion and form the bench portion of the sofa. When configured as a bed, the front portion pivots forward and away from the intermediate portion which is then raised into horizontal alignment with the pivoted front portion to form a bed surface.

U.S. Pat. No. 2,673,354 sets forth a convertible sofa bed which provides a fixed bench cushion serving as the seat bottom in the sofa position and a pivotable seat back which pivots between an upright position corresponding in the sofa configuration and a horizontal position in alignment with the fixed bench cushion to form a bed in the alternative configuration.

U.S. Pat. No. 3,310,815 sets forth a convertible sofa bunk having a pair of cushions supported by a rigid frame. In the sofa configuration, the first cushion is upright to form a seat back and the second cushion is horizontal to form a seat bench. In the alternate or bunk configuration, the second cushion slides foward to extend beyond the supporting frame of the convertible sofa bunk and the first cushion is pivoted about its upper edge to a horizontal position parallel to and raised from the second cushion. Linkage arms within the support structure latch the cushions in position to provide an offset bunk bed type arrangement.

While the sofa beds and similar devices, such as those described above, provide the advantages of dual configuration between a sofa and a bed, they are usually difficult and cumbersome to move between their two configurations. Often, the positioning and alignment of one or more of the cushions require that separate assembly be positioned and locked in place in order to provide the required support beneath a cushion in the bed configuration. Further, many of the prior art sofa bed structures provide their latching or locking function through the use of a combination of pivoting arms and spring members in which the positions of the cushions are maintained by moving the arm configurations "over-center" against the spring force. In the case of larger sofa bed units or operation by elderly persons or young children, the use of such spring force over-center structures requires an excessive or disproportionate force to reconfigure the sofa bed. As a result, the motion of the cushions and there supports between the two configurations is often difficult.

There remains therefore a need in the arm for a convertible sofa bed which utilizes a support system which provides for easy transfer between the sofa and bed configurations of the device while simultaneously providing a secure and reliable latching action in each configuration.

SUMMARY OF THE INVENTION

Accordingly, it is a general object of the present invention to provide an improved sofa bed. It is a more particular object of the present invention to provide an improved sofa bed which may be readily and smoothly moved between its sofa and sleeping bed configurations.

In accordance with the invention there is provided a multiply configurable sofa bed having a rigid articulated frame supporting first, second and third cushions. When configured in the sofa configuration, the second cushion assumes a horizontal position with the first cushion extending downwardly therefrom to form a leg rest and a third cushion extending upwardly therefrom to form the seat back of the sofa configuration. Means are provided for arranging the first, second and third cushions in a substantially coplanar horizontal arrangement to provide a sleeping bed configuration. A novel combination of pivotal arms and latch mechanism cooperate to transition the first cushion between its sofa and bed configurations and to maintain it in each position without the use of spring retaining means.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several Figures of which like reference numerals identify like elements and in which:

DESCRIPTION OF THE PREFERRED EMBODIMENT

Figure 1:
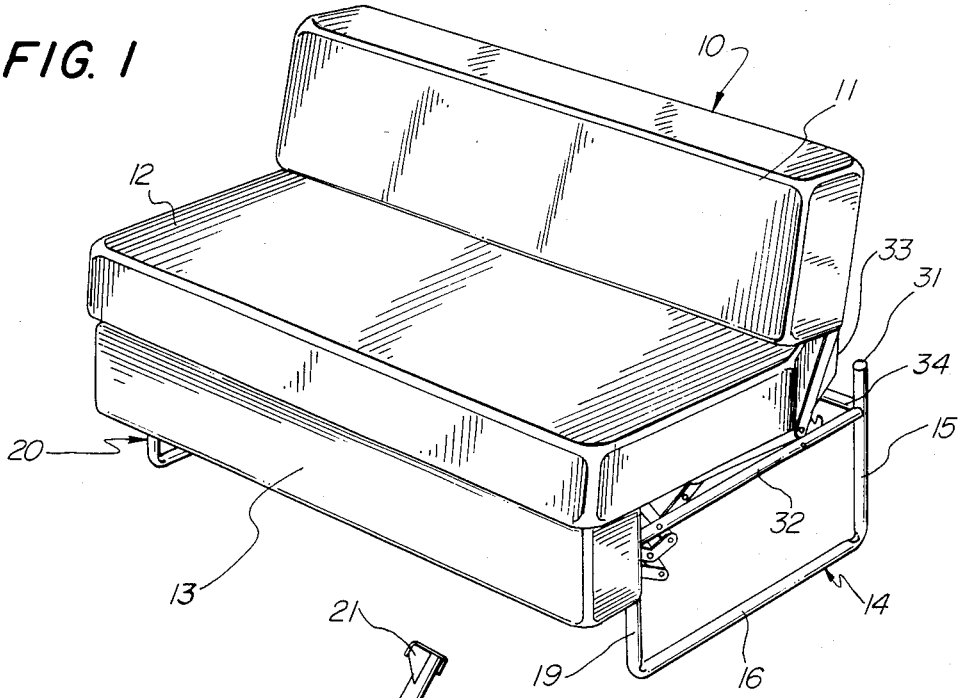
FIG. 1 is a perspective view of a sofa bed constructed in accordance with the present invention.

FIG. 1 shows a perspective view of the present invention sofa bed generally referenced by numeral 10 and having a substantially upright back cushion 11, a substantially horizontal seat cushion 12 and a substantially vertical front cushion 13. The configuration shown in FIG. 1 is the sofa configuration. A pair of generally U-shaped rigid side frames 14 and 20 are positioned as supports on each end of sofa 10 and secured together by a cross piece 34 traversing the back portion of sofa 10 beneath back cushion 11. Side frames 14 and 20 are of substantially identical construction. Side frame 14 comprises an upwardly facing U-shaped structure having a vertical support 15 and a vertical support 19 with a transverse cross support 16 coupled therebetween. A side piece 32 is secured to vertical support 15 and vertical support 19. Vertical support 15 further defines an upwardly extending end portion 31. Back cushion 11 is, as will be explained below in greater detail, supported in its upright position by a generally upwardly extending bar member 33. It will be apparent to those skilled in the art that the frame support mechanism for the present invention sofa is substantially symetrical about its center line. Accordingly, while in the drawings set forth herein and the disclosure relating thereto one side or the other of the support means are described in detail, it should be understood in each structure that a corresponding mirror image configuration is constructed on each side of the sofa.

Figure 2:
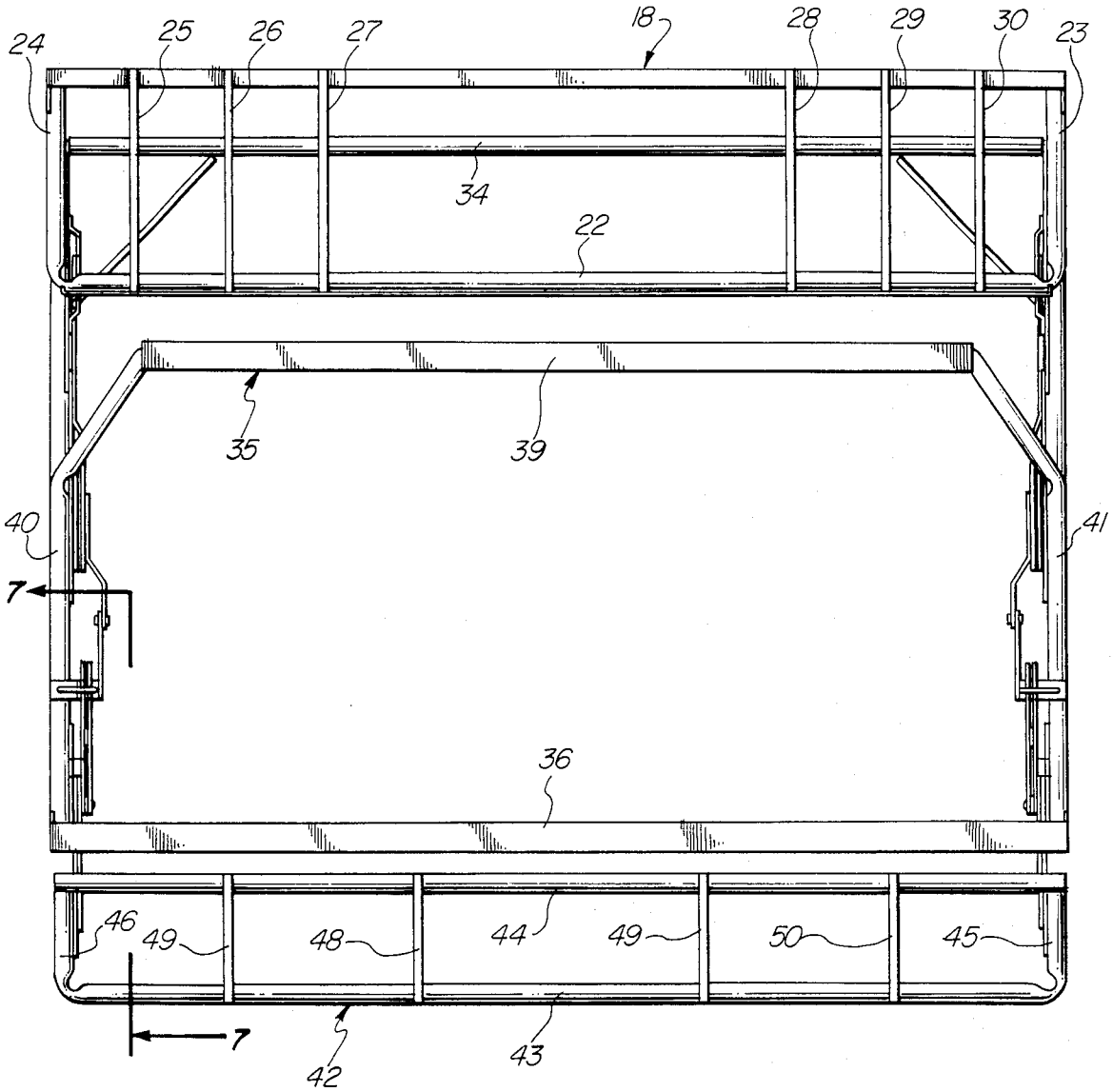
FIG. 2 is a top view of the present invention sofa bed in the extended or bed configuration with cushions removed.

FIG. 2 is a top view of the frame portion of the present invention sofa bed with cushions 11, 12 and 13 removed. As will be apparent to those skilled in the art, FIGS. 2 through 9 show the present invention sofa bed or portions thereof with cushions 11, 12 and 13 removed for purposes of illustration and to provide the necessary views of the sofa frames and support structures. FIG. 2 shows the present invention sofa frame in the fully extended or bed position corresponding to the side view shown in FIG. 6 in which back frame 18, which comprises a generally U-shaped rigid structure formed by back side frame 24, lower back rail 22 and back side frame 23 together with upper back rail 21, is oriented in the horizontal position (better seen in FIG. 6). Back frame 18 further includes a plurality of cross bars 25 through 30 which are coupled between upper back rail 21 and lower back rail 22. Cross bars 25 through 30 provide a support structure which evenly supports back cushion 11 when attached to back frame 18. A seat frame 35 comprising a substantially U-shaped rigid structure formed by a side piece 40, a cross piece 39 and a side piece 41 in a generally U-shaped configuration together with a cross piece 36 which is coupled between side pieces 40 and 41 to form a generally rectangular seat frame support. Seat frame 35 supports seat cushion 12 and, in the position shown in FIGS. 2 and 6, is oriented in a horizontal position substantially coplanar with back frame 18. By means omitted from FIG. 2 for purposes of clarity, but which should be understood to be included in the structure of sofa 10, a number of cross supports extending between cross pieces 36 and 39 and side pieces 40 and 41 are incorporated in seat frames 35 or in the structure of seat cushion 12 to support seat cushion 12 in its normal use. A front extension 12 comprising a generally U-shaped rigid member formed by a pair of sides 45 and 46 together with a cross piece 43 further includes a cross piece 44 coupled between sides 45 and 46 to produce a generally rectangular rigid frame structure. A plurality of struts 49 through 52 are distributed between cross pieces 43 and 44. Struts 49 through 52 serve a similar function to that set forth above for cross bars 25 through 30 in that they provide a distributed support for front cushion 13. As will be apparent by simultaneous reference to FIGS. 2 and 6, the frame structure of the present invention sofa in the bed configuration places front extension 42, seat frame 35 and back frame 18 in a substantially coplanar horizontally oriented position which in turn should be understood to position front cushion 13, seat cushion 12 and back cushion 11 in a similar horizontal coplanar arrangement.

Figure 3:
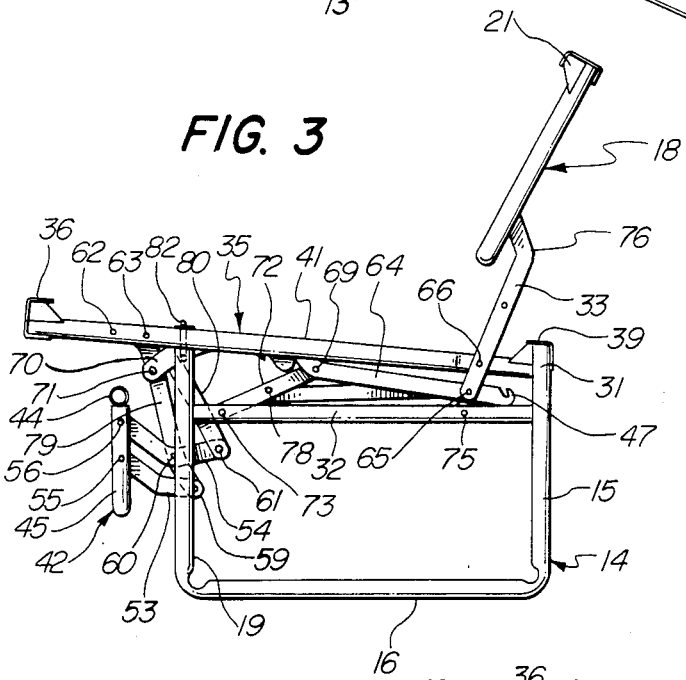
FIG. 3 is a side view of the present invention sofa bed in the sofa configuration with the cushions removed.

FIG. 3 shows a side view of the frame portion of the present invention sofa 10 as it would appear in the sofa configuration shown in FIG. 1 with cushions 11, 12 and 13 removed. As can be seen, side frame 14 is supported upon the underlying floor surface by cross support 16 and upwardly extending vertical supports 15 and 19, together with side piece 32, form one-half of the load bearing support of sofa 10. As expressed above, an identical side frame 20 (not visible) should be understood to be situated on the other side of the present invention sofa frame shown in FIG. 3 which together with side frame 14 supports the entire weight of sofa 10. In the position shown in FIG. 3, seat frame 35 is substantially horizontal and provides the seat portion of the sofa while front extension 42 is supported in a generally and vertically oriented position. The position of front extension 42 with respect to cross piece 36 of side frame 35 is selected in accordance with the thickness of front cushion 13 to provide that the relative positions of front cushion 13 and the front edge 17 of seat cushion 12 are in substantial alignment. This aspect is provided to ensure relative comfort and a configuration of cushions corresponding closely to a conventional sofa.

Side piece 32 defines a pair of pivot points 73 and 75. A bar 72 is coupled at one end to pivot 73 and at the other end to pivot 69 of arm 64. Arm 64 is attached at one end to seat frame 35 while the other end defines a hook 47. In the position shown, arm 64 is substantially parallel to seat frame 35. A bar 33 extends upwardly from and is pivotally attached to arm 64 at a pivot 65 at one end and terminates in a bend 76 at the other. Bend 76 is attached to back frame 18 and supports back frame 18. A pivot 66 further couples bar 33 to seat frame 35. A pair of parallel arms 53 and 54 are coupled to front extension 42 by pivots 55 and 56 respectively and extend rearwardly from side 45 of front extension 42. A second pair of arms 79 and 80 are substantially parallel in the position shown in FIG. 3 and are coupled to seat frame 35 by pivots 62 and 63 at one end and to arms 53 and 54 at the other end by pivots 59 and 61 respectively. An additional pivotal attachment 60 couples an intermediate point of arm 54 to arm 79. As will be described below in greater detail, the operation of parallel arms 53 and 54 together with parallel arms 79 and 80 cooperate to move front extension 42 between its retracted position shown in FIG. 3 and its extended position shown in FIGS. 2 and 6. A generally curved slide bar 70 is pivotally attached at a pivot 71 to arm 79 at one end and extends generally rearwardly and curves upwardly from pivot 71. A latch loop 82, shown below in greater detail, cooperates with and interlocks with slide bar 70 by means set forth below in greater detail to lock front extension 42 in the sofa position shown in FIG. 3.

Figure 4:
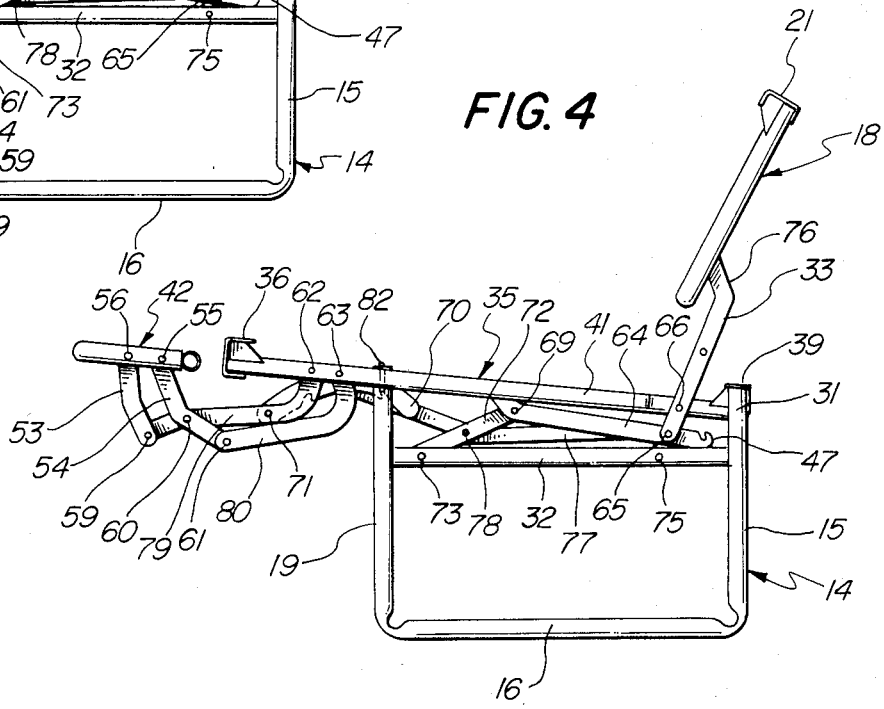
FIG. 4 is a side view of the present invention sofa bed in the sofa position with the front extension in the raised position with the cushions removed.

FIG. 4 shows a side view of the frame members of the present invention sofa in an intermediate position between the sofa and bed configuration which provides a recliner-type configuration characterized by the raised position of front extension 42. In the position shown in FIG. 4, the remaining portions of the frame assume the same positions shown in FIG. 3 in that bar 33 extends generally upwardly from its pivotal attachments to seat frame 35 and arm 64 and supports back frame 18 in the upright position. In further similarity, vertical side frame 14 rests upon cross support 16 with vertical supports 15 and 19 extending upwardly in attachment to side piece 32 and seat frame 35 to support the weight of sofa 10. As mentioned however, the orientation of frame members shown in FIG. 4 differs from that in FIG. 3 in that front extension 42 is supported in its raised position such that it is substantially coplanar with seat frame 35 to form a leg rest. In the raised position shown, parallel arms 53 and 54 cooperate with parallel arms 79 and 80 to permit front extension 42 to be drawn forwardly from the position shown in FIG. 3 such that arms 79 and 80 pivot about pivots 62 and 63 respectively. Similarly, as front extension 42 is drawn from the position shown in FIG. 3 to that shown in FIG. 4, arms 53 and 54 pivot about pivots 59 and 61 to properly position front extension 42. The appropriate relationship between arms 53 and 54 and arms 79 and 80 is provided by the mutual pivot at pivot 60 between arm 43 an arm 79.

In accordance with an important aspect of the present invention described below in greater detail, slide bar 70, due to its pivotal attachment 71 at arm 79, is drawn forward with respect to latch loop 82 as arm 79 pivots about pivot 62. The action of slide bar 70 and latch loop 82 is set forth below in greater detail in connection with discussion relating to FIGS. 7, 8 and 9. However, suffice it to note here that latch loop 82 and slide bar 70, by such further described means, cooperate to provide a latching interaction whereby front extension 42 may be locked in the position shown in FIG. 3 and in the extended position shown in FIG. 4.

Figure 5:
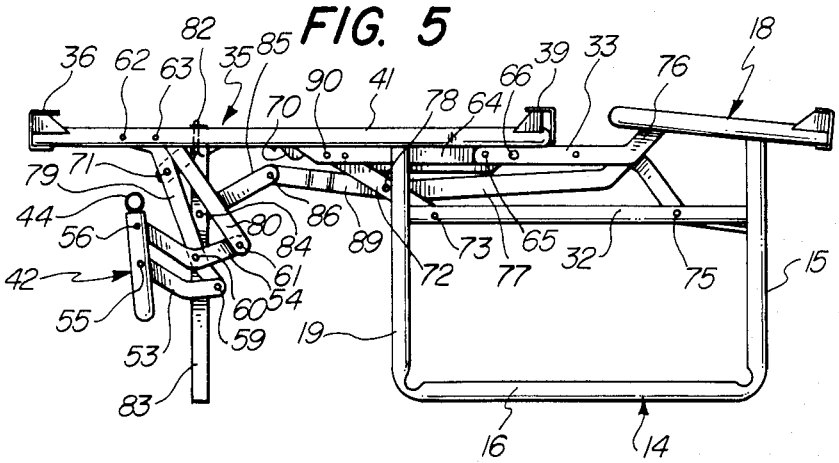
FIG. 5 is a side view of the present invention sofa bed in the bed position with the front extension lowered and the cushions removed.
Figure 6:
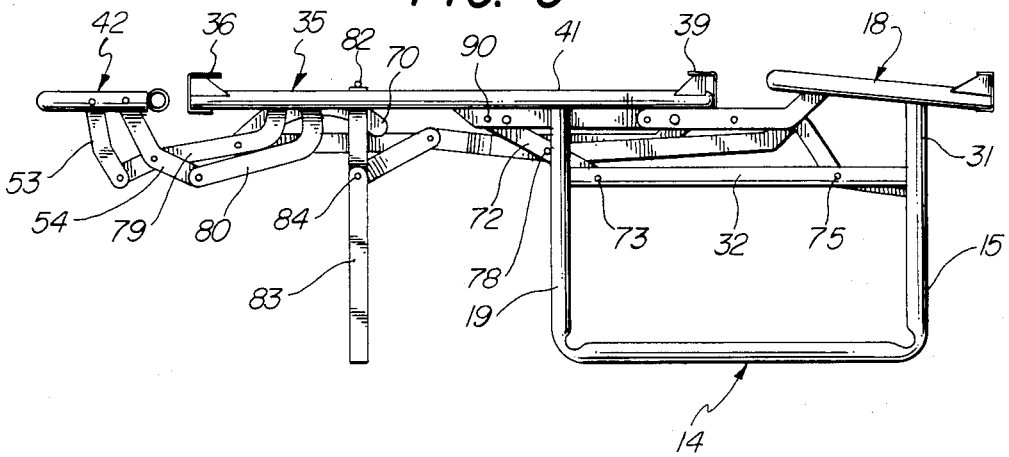
FIG. 6 is a side view of the present invention sofa bed in the bed configuration with the front extension raised and the cushions removed.

FIG. 5 shows the present invention sofa frame configured in a bed configuration in which front extension 42 is in the retracted position. A comparison of FIGS. 3 and 5 shows that back frame 18 has been lowered from its up raised position in FIG. 3 to a substantailly horizontal lowered position. In addition, seat frame 35 has been drawn forwardly and upwardly from the position shown in FIG. 3. As can be seen in FIG. 5, seat frame 35 now extends a substantial distance beyond vertical support 19 of side frame 14. Seat frame 35 is moved from the position shown in FIG. 3 to that shown in FIG. 5 by drawing seat frame upwardly and forwardly (to the left in FIG. 5). As seat frame 35 is so moved, bar 72, which is pivotally attached at one end at a pivot 73 to side piece 32 and at the other end to arm 64 by pivot 90, is rotated in a counter clockwise direction. Bar 72 is pivotally joined at an intermediate pivot 78 to arms 77 and 89. Arm 77 is pivotally attached at a pivot 75 to side piece 32 while arm 89 is pivotally attached at a pivot 86 to one end of arm 85. The remaining end of arm 85 is pivotally attached to a leg 83 at pivot 84.

Due to the cooperation of bar 33 and arms 77 and 64 as well as pivots 65 and 66, the motion of seat frame 35 forward and the rotation of bar 72 causes bar 33 to be pivoted in a clockwise direction lowering back frame 18 to its horizontal position. In addition, the cooperation of arms 85 and 89, during the motion of bar 72 and seat frame 35, causes leg 83 to be pivoted about pivot 84 to a vertical position shown in FIG. 5. This pivoting motion of leg 83 to a vertical position is necessary due to the extension of seat frames 35 beyond vertical support 19 of side frame 14. Without the position of leg 83 as shown, weight placed upon seat frame 35 would tend to cause sofa 10 to tip. In the position shown in FIG. 5, front extension 42 remains locked in its retracted or lowered position. As a result, the resulting width of the bed is substantially less than the width produced by the fully extended configuration shown in FIGS. 2 and 6.

FIG. 6 shows a side view of the present invention sofa in its fully extended position which is substantially identical to the configuration shown in FIG. 5 with the exception of the position of front extension 42. Comparison of FIGS. 4 and 6 shows that the position of front extension 42 is fully extended and corresponds to that shown in FIG. 4. Accordingly, front extension 42 is locked by the cooperation of slide bar 70 and latch loop 82 and, as is described below in greater detail, in its fully extended position. The difference between FIGS. 4 and 7 is found primarily in the forward position of seat frame 35 and thet reclined position of back frame 18.

Examination of FIGS. 3, 5 and 6 can be utilized as a sequential depiction of the movement of the support frame of the present invention sofa from the sofa position of FIG. 3 to the fully extended bed position shown in FIG. 6. As can be seen, the change from FIG. 3 to FIG. 5 is provided by the forward drawing motion of seat frame 35 with respect to side frame 14 which, in accordance with the above-described operation, causes back frame 18 to be lowered to its fully reclined position and causes the vertical positioning of leg 83. Thereafter, moving the present invention sofa from the configuration of FIG. 5 to that shown in FIG. 6 for full width of the bed configuration, is accomplished by drawing front extension 42 forwardly and upwardly from its position in FIG. 5 to that shown in FIG. 6. In accordance with an important aspect of the present invention, front extension 42 is latched in its retracted position shown in FIG. 5, by the cooperation of latch loop 82 and slide bar 70. Similarly, the drawing motion of extension 42 from the retracted position of FIG. 5 to the fully extended position of FIG. 6 permits slide bar 70 and latch loop 82 to similarly cooperate to lock and secure front extension 42 in the fully extended position of FIG. 6.

Figure 7:
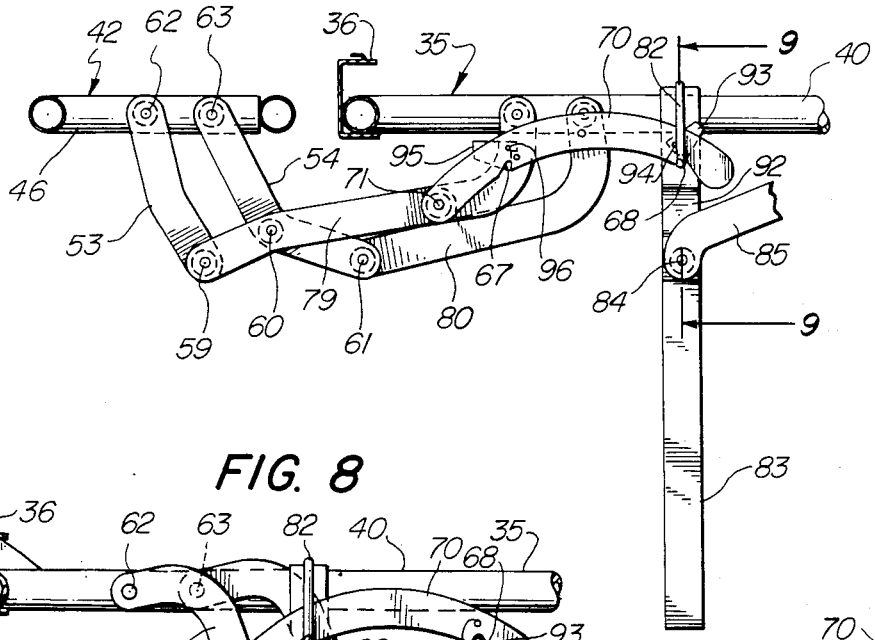
FIG. 7 is a partial section view of a portion of the present invention sofa bed taken along section lines 7—7 in FIG. 2.
Figure 8:
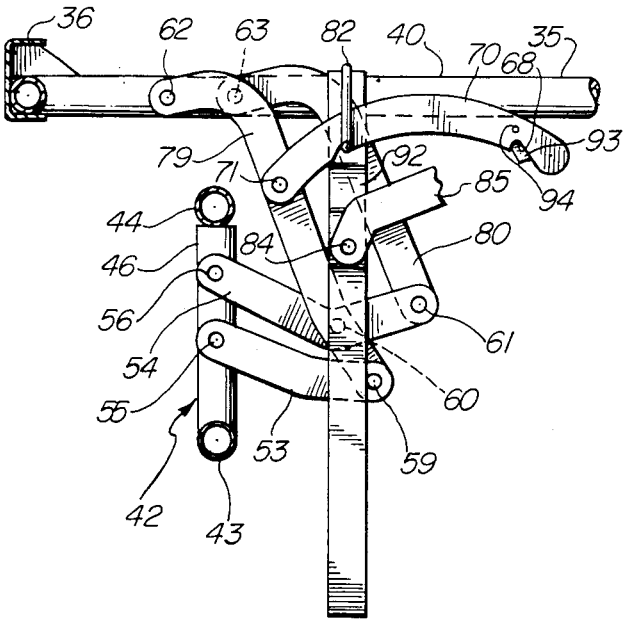
FIG. 8 is a second view similar to FIG. 7 of a portion of the present invention sofa bed showing the front extension in its lowered position.

FIGS. 7 and 8 show the latching mechanism of the present invention in the extended and retracted configurations of front-extension 42 in greater detail. In FIG. 7 with front extension 42 in its extended position in which slide bar 70 is locked to latch loop 82. As can be seen in FIGS. 7 and 8, slide bar 70 defines a pair of downwardly facing notches 67 and 68. Further, a latch plate 95 having a generally trapezoidal shape is pivotally secured to slide bar 70 above notch 67 by a pin 96. Because pin 96 secures latch plate 95 to slide bar 70 in an offset or off center configuration, latch plate 95 responds to gravity and tends to rotate downwardly and obstruct notch 67. A second latch plate 93, similar in construction to latch plate 95, is secured to slide bar 70 by a pin 94 just above notch 68. As is the case with latch plate 95, latch plate 93 is freely pivotable about pin 94 and tends to rotate in the absence of latch loop 82 to a position blocking notch 68.

In the position shown in FIG. 7 however, latch plate 93 has been rotated from its position blocking notch 68 by the action of latch loop 82 and latch loop 82 is captivated within notch 68. In accordance with an important aspect of the present invention, this latching is explained below in greater detail. However, suffice it to note here that as front extension 42 is pulled to its full forward and upward extension slide bar 70 is drawn through latch loop 82 to an extent that notch 68 passes beyond latch loop 82. Thereafter, the position of front extension 42 is locked in place by forcing front extension 42 back toward cross piece 36 which in turn drives slide bar 70 rearward (to the right in FIG. 7). The movement of slide bar 70 to the right causes latch loop 92 to intrude into notch 68 and rotate latch plate 93 out of notch 68. Thereafter, latch loop 82 nests within the notch 68 and secures slide bar 70 and in turn maintains the position of front extension 42.

Front extension 42 may be moved from the extended position of FIG. 7 to the retracted position of FIG. 8 by initially drawing front extension 42 to the left, that is away from cross piece 36, which causes slide bar 70 to be drawn to the left which in turn causes latch loop 82 to be drawn from notch 68. With latch plate 82 drawn from notch 68, latch plate 93 again rotates clockwise to obstruct notch 68. Thereafter, the downward motion of front extension 42 causes slide bar 70 to be moved through latch loop 82 without the interaction of latch loop 82 and notch 68. Thus front extension 42 may be pushed downward and rearward until the position in FIG. 8 is attained, at which time front extension 42 may be locked in its retracted position by forcing front extension 42 to the right a short distance and then draw front extension 42 to the left slightly drawing slide bar 70 to the left slightly causing latch loop 82 to extend into notch 67. Continued motion of front extension 42 in this manner causes latch loop 82 to rotate latch plate 95 out of obstruction of notch 67 and permits latch loop 82 to nest within notch 67 and lock the position of front extension 42.

The return of front extension 42 to its extended position is accomplished by forcing front extension 42 slightly to the right a sufficient distance to cause latch loop 82 to be drawn from notch 67. Thereafter, latch plate 95 again rotates in a counter clockwise direction to again obstruct notch 67. Front extension 42 may then be drawn to the left because the presence of latch plate 95 in notch 67 permits slide par 70 to move through latch loop 82 and the front extension 42 may again be positioned in its extended position shown in FIG. 7 and locked therein in accordance with the above-described operation.

Figure 9:
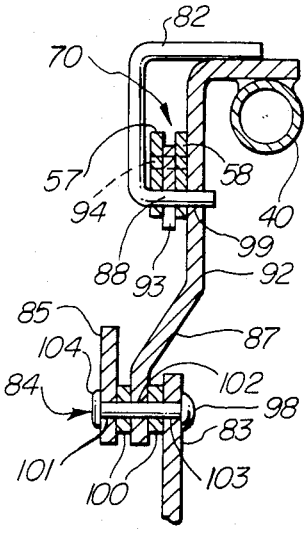
FIG. 9 is a section view of a portion of the present invention sofa bed taken along section lines 9—9 in FIG. 7.

FIG. 9 shows a section view of a portion of the present invention sofa frame which sets forth in greater detail the inventive latching mechanism by which slide bar 70 and latch plates 93 and 95 cooperate to provide a convenient latching mechanism which is operative to lock front extension 42 is either the raised or retracted positions shown in FIGS. 7 and 8. An aspect of the preferred embodiment is shown in FIG. 9 which is not visible in the remaining figures. Slide bar 70 in its preferred form comprises a pair of identical curved bars 57 and 58 and latch plate 93 is supported between bars 57 and 58 by a pin 94. While not visible in FIG. 9, it should be understood that a similar arrangement supports latch plate 95 between bars 57 and 58 using pin 96 in the positions shown in FIGS. 7 and 8. It should be further understood that as mentioned above in an accordance with an important aspect of the present invention, latch plates 95 and 93 are freely pivotal about their respective pins 96 and 94 between slide bars 57 and 58. It should be further understood that the arrangement utilizing slide bar 70 fabricated from two identical bars 57 and 58 is the preferred embodiment of the present invention. However, it will be apparent and should be understood that slide bar 70 may in the alternative comprise a single curved bar bearing notches 67 and 68 and supporting latch plate 95 and 93 without departing from the spirit and scope of the present invention.

Returning now to FIG. 9, brace 92 is securely attached to side piece 40 by a weld 97 and that latch loop 82 which comprises a substantially U-shaped member is secured at its upper end to the top portion of brace 92 overlying side piece 40 by any convenient means such as welding. Latch loop 82 terminates at its other end in a substantially straight portion latch rod 88 which extends through aperture 99 defined in brace 92. As a result, latch loop 82 is securely attached to brace 92 and forms a rigid structure through which slide bar 70 travels in accordance with the above described latching function. Brace 92 further defines an offset 87 and terminates at pivot at 84 and defines an aperture 102. Leg 83 extends upwardly in the vertical direction and defines an aperture 103 at pivot 84. Similarly, arm 85 extends downwardly to pivot 84 and defines an aperture 101. A pair of annular spacers 100 are interposed between brace 92 and leg 83 and between arm 85 and brace 92 to properly align and space arms 85, brace 92 and leg 83 in their pivotal motion about pivot 84. Pivot 84 further comprises a pin 98 extending through apertures 101, 102 and 103 and spacers 100 which terminates in a expanded head 104.

In operation, latch plates 93 and 95 are freely pivotable about pins 94 and 96 respectively and, as mentioned above, define trapezoidal shaped structures which under the force of gravity pivot to positions blocking their respective notches 68 and 69 in slide bar 70. Returning for a moment to FIG. 7, it should be noted that notches 67 and 68 are not symmetrical with respect to slide bar 70 but rather are formed therein with inclined axes whereby they captivate latch rod 88 of latch loop 82 if approached in one direction but tend to release it in the other. Specifically, notch 67 is inclined away from pivot 71 such that latch rod 88 within notch 67 is captivated by forces upon slide bar 70 toward pivot 71 (that is to the left in FIGS. 7 and 8). On the other hand, notch 67 due to its inclined orientation does not intend to captivate latch rod 88 in response to motion of slide bar 70 away from pivot 71 (that is to the right in FIGS. 7 and 8). Similarly, because the incline of notch 68 is the mirror image of notch 67, it captivates latch rod 88 when slide bar 70 is moved to the right in FIG. 7 but releases latch rod 88 when slide bar 70 is moved to the left.

In assuming the position shown in FIG. 7, slide bar 70 is securely locked by the engagement of latch rod 88 within notch 68. It should be noted that latch plate 93 has been pivoted away from notch 68 by the intrusion of latch rod 88. As will be apparent from examination of FIG. 7, downward forces of the type produced by weight placed upon front extension 42 cause arms 53 and 54 to couple a force to arms 79 and 80 which tend to pivot arms 79 and 80 in a counterclockwise direction abouts pivots 62 and 63 respectively. The counterclockwise motion of arms 79 in turn causes slide bar 70 to be forced to the right due to the coupling between arms 79 and slide bar 70 at pivot 71. As mentioned, with latch rod 88 embedded in notch 68 forces tending to move slide bar 70 to the right are resisted by notch 68's engagement of the latch rod. As a result, in the extended position shown, front extension 42 is locked and may support weight and thereby perform its function as a cushion support in the bed configuration. Front extension 42 maybe collapsed or moved from its extended position in FIG. 7 to the retracted position in FIG. 8 by drawing front extension 42 away from the sofa frame in the direction to the left in FIG. 7. The resulting force pulls front extension 42 leftwardly causing arms 79 and 80 to pivot in a clockwise direction about pivots 62 and 63 respectively. The coupling of pivot 71 in turn draws slide bar 70 to the left. As mentioned, motion of slide bar 70 to the left is not resisted by the engagement of notch 68. Accordingly, slide bar 70 is drawn to the left in a motion which causes latch rod 88 to be removed from notch 68. With slide bar 70 drawn to the left and the resulting removal of latch rod 88 from notch 68, latch plate 93 rotates in the clockwise direction due to its offset support at pin 94 and blocks notch 68. Thereafter, with latch plate 93 so positioned, front extension 42 may be moved in the downward direction and slide bar 70 will be moved to the right due to the downward motion of front extension 42 being coupled by arms 53 and 54 and arms 79 and 80 which causes slide bar 70 to move rightwardly through latch loop 82. As slide bar 70 moves through latch loop 82, the latch rod 88 traverses notch 68 without engagement due to the obstructing position of latch plate 93. Thereafter, front extension 42 may be moved downward and rearwardly to the collapsed or retracted position shown in FIG. 8. As the position shown in FIG. 8 is approached, notch 67 approaches latch rod 88 from the right and contacts latch plate 95. Because of the offset support of latch plate 95, latch rod 88 causes latch plate 95 to rotate in a clockwise direction as slide bar 70 moves to the right. With the rotation of latch plate 95, latch rod 88 falls into notch 67. The latching of front extension 42 in the retracted position may then be accomplished by drawing front extension 42 to the left slightly causing latch rod 88 to nest within notch 67. To move from the retracted position shown in FIG. 8 to the extended position of FIG. 7, front extension 42 if forced to the right causing slide bar 70 to move to the right and causing latch rod 88 to be withdrawn from notch 67. The withdrawing of latch rod 88 from notch 67 permits latch plate 95 to pivot in a counterclockwise direction and obstruct notch 67. Thereafter, front extension 42 may be drawn to the left and the action of latch plate 95 obstructs notch 67 permitting slide bar 70 to be drawn to the left and passing notch 67 throught latch loop 82.

What has been shown in a sofa bed having a front extension which may be latched in either an extended or a collapsed position in a positive secure locking function without the use of cumbersome over-center spring and arm combinations. As a result, a secure and positive latching mechanism is provided in which and the unlatching it easily accomplished without the need for overcoming the retaining forces heretofore encountered in the prior art mechanisms.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

What is claimed is:

1. In a multiply configurable sofa bed having a rigid articulated frame supporting first, second and third cushion supports configurable in a sofa configuration, in which said second cushion support assumes a horizontal position and said first cushion support extends downwardly therefrom to form a leg rest and said third cushion support extends upwardly from said second cushion support to form a seat and configurable in a bed configuration in which said first, second and third cushion supports are positioned in a substantially coplanar horizontal arrangement; latching support means operative upon said first cushion support comprising:

first and second elongated scissor arms having a common pivotal attachment therebetween, said first scissor arm having a first end pivotally attached to said first cushion support and a second end and said second scissor arm having a first end pivotally attached to said second cushion support and a second end;

a third arm having a first end pivotally attached to said first cushion support and a second end pivotally attached to said second end of said second scissor arm;

a fourth arm having a first end pivotally attached to said second end of said first scissor arm and a second end pivotally attached to said second cushion support;

a slide bar having a first end pivotally attached to said second scissor arm intermediate said first and second ends thereof, a second end, and first and second notches intermediate said first and second ends of said slide bar; and latch means supported by and rigidly attached to said second cushion support and including a latch rod substantially perpendicular to said slide bar and sized to be received within said first and second notches, and first and second cams pivotally attached to said slide bar proximate said first and second notches respectively, said first and second cams each being pivotable between positions obstructing said first and second notches and positions clear of said first and second notches.

2. Latching support means as set forth in claim 1 wherein said slide bar is caused to move laterally in response to motion of said first cushion support and defines a lower edge which rests upon said latch rod during slide bar motion and wherein said first and second notches are defined in said lower edge and have sloped edges extending inwardly from said lower edge.

3. Latching support means as set forth in claim 2 wherein said sloped edges of said first and second notches form different angles with said lower edges such that said latch rod tends to be captivated when forced into one of said notches in one direction of slide bar lateral motion and tends to be released when forced into one of said notches in the other direction of slide bar lateral motion.

4. Latching support means as set forth in claim 3 wherein said first and second cams define respective first and second camming surfaces which span said first and second notches respectively when in said positions obstructing said first and second notches and wherein said first and second cams are pivoted away from said positions obstructing said notches by said latch rod when said latch rod is captivated within one of said notches.

5. Latching support means as set forth in claim 4 wherein said first notch captivates said latch rod when said first cushion support is in said sofa configuration and said second notch captivates said latch rod when said first cushion is in said bed configuration.

6. Latching support means as set forth in claim 5 wherein said first and second notches are mirror images of each other and wherein said first and second notches captivate said latch rod in opposite directions of slide bar lateral motion.

* * * * *